US005471696A

United States Patent [19]

Linfoot

[11] Patent Number: 5,471,696

[45] Date of Patent: Dec. 5, 1995

[54] HOOKED CLEANING TOOL FOR WOODEN DECKS

[76] Inventor: Lance W. Linfoot, P.O. Box 615, Laytonville, Calif. 95454-0615

[21] Appl. No.: 425,886

[22] Filed: Apr. 21, 1995

Related U.S. Application Data

[63] Continuation-in-part of Ser. No. 280,771, Jul. 25, 1994, abandoned.

[51] Int. Cl.[6] ..... A47L 13/00

[52] U.S. Cl. ..... 15/104.001; 294/19.1

[58] Field of Search ..... 15/1, 104.001, 15/236.01, 236.05–236.09; 114/221 R; 294/19.1, 24, 26

[56] References Cited

U.S. PATENT DOCUMENTS

| | | | |
|---|---|---|---|
| 172,891 | 2/1876 | Poole | 294/26 |
| 1,045,679 | 11/1912 | Cronin . | |
| 1,404,117 | 1/1922 | Hanson | 294/26 |
| 1,512,315 | 10/1924 | Sandford . | |
| 2,291,593 | 7/1942 | Hubbard . | |
| 2,562,794 | 7/1951 | Kalish | 294/24 |
| 2,597,400 | 5/1952 | Stogsdill et al. | 294/26 |
| 3,004,362 | 10/1961 | Day | 294/19.1 |
| 3,048,139 | 8/1962 | Duckett | 294/24 |
| 3,354,520 | 11/1967 | Morgen . | |
| 3,463,533 | 8/1969 | Repiscak et al. . | |
| 3,936,088 | 2/1976 | Williams | 294/19.1 |
| 4,004,539 | 1/1977 | Wesson | 294/19.1 |
| 4,624,494 | 11/1986 | Huppert | 294/26 |
| 4,881,338 | 11/1989 | Lung | 294/26 |

FOREIGN PATENT DOCUMENTS

| | | | |
|---|---|---|---|
| 2691349 | 11/1993 | France | 15/104.001 |
| 89150 | 4/1957 | Norway | 15/236.01 |
| 89464 | 6/1937 | Sweden | 114/221 R |
| 1142779 | 2/1969 | United Kingdom | 294/19.1 |
| 2262792 | 6/1993 | United Kingdom | 15/104.001 |

*Primary Examiner*—Mark Spisich

[57] ABSTRACT

A hand-held, hooked cleaning tool for removing debris from the intermediate gaps between the boards of architectural wooden decks; the tool having a T-shaped tool head (30) fitted into a low friction, non-marring nose piece (18), both attached to a handle (10). The tool head (30) is configured with two adjoining hook portions that effect cleaning of the gaps between deck boards; with the operator applying either pushing or pulling motion to the handle.

20 Claims, 5 Drawing Sheets

OPERATION

OPERATION

HOOKED CLEANING TOOL FOR WOODEN DECKS

CROSS-REFERENCE TO RELATED APPLICATION

This is a continuation-in-part of my earlier application, Ser. No. 08/280,771; filed Jul. 25, 1994, now abandoned.

BACKGROUND

1. Field of the Invention

This invention relates generally to yard maintenance tools, specifically to a cleaning tool for cleaning the gaps in architectural wooden decks.

2. Prior Art

A common architectural feature of the modern house is the exterior wooden deck. The surfaces of most wooden decks are constructed of boards which are nailed or screwed to an underlying set of cross beams. In almost all cases, adjacent deck boards are spaced apart slightly so as to form gaps therebetween. The gaps allow drainage, ventilation, and expansion and contraction of the boards. However, these gaps collect leaves, small flowers, flower petals, acorns, twigs, seeds, seedpods, pebbles, dirt, etc. The unsightly debris, when wet with water, cause decay of the deck boards and the cross beams thereunder. Therefore, it is known that deck gaps should be cleaned regularly to maintain the appearance and structural integrity of the deck. However, the proper cleaning of these gaps has been hindered by the lack of an effective tool specifically made for the job.

A list and analysis of the known cleaning methods are as follows:

(a) The use of low-pressure water, (such as a garden hose with nozzle), is safe but only partially effective. This method is highly ineffective for removing solid debris lodged between the boards, and as the board spacing narrows, becomes increasingly ineffective in removing loose debris. This method also uses water in very large quantities, which is costly in many municipal water districts, and is wasteful of our ever diminishing water resources.

(b) The use of high-pressure water, (such as is generated by portable, high-pressure washing apparatus), also has several disadvantages. This apparatus is costly to buy or rent, is inherently very messy, and its safe use is problematical for the average homeowner. High-pressure water may also serve only to drive debris deeper into the gap between deck boards. This method may also damage the wooden surface or strip away the surface coating, making repair or refinishing necessary.

(c) Using brooms, brushes, or other bristled devices is very ineffective where any solid debris is present. A bristled device flexible enough to penetrate deeply between the deck boards will not exert sufficient force on most solid debris to dislodge it. Wire brushes and other devices with very stiff bristles will dislodge the debris in many cases, but the bristles damage the deck surface. Bristled devices also tend to lose bristles with use, making them increasingly ineffective. Bristled devices will also snag or catch on any cracks or checks present on the edges, corners, or surfaces of the boards.

(d) Screw-drivers, awls, putty knives, knives, and other bladed or pointed-type tools have all been used to clean the gaps between deck boards. These tools all can be effective on lodged or deeper debris, but have major disadvantages. The need to kneel, sit, crouch, or bend while using these tools is a major ergonomic liability. The ergonomic difficulties inherent in using these tools dictate a slow rate of work. But the most important disadvantage is in the realm of safety. It is unsafe to use these tools for a purpose for which they were not designed or intended, and serious injury could result from this practice.

Devices that were designed for other applications are generally not suitable for cleaning deck gaps. U.S. Pat. No. 172,891 to Poole (1876) shows a stick for stirring and fishing out clothes from a laundry bath. It includes an elongated handle A, a nose piece B, and two rod-shaped hooks C. It cannot be used for cleaning deck gaps, because the thick, round hooks cannot be inserted into the narrow gaps. If the diameters of the hooks are suitably reduced to fit the gaps, then they will become so thin that they will be easily bent or broken during normal use. The spherical tips of the hooks also hinder the insertion thereof into the gaps. Furthermore, the cylindrical nose piece has a flat end, so that the depth at which the hook is inserted into a gap will vary according to the angle at which the handle is held. Each hook will only reach the greatest depth in a gap when the handle is held flat against the deck—an awkward position which makes maneuvering the tool very difficult.

U.K. patent 1,142,779 to Dech (1969) shows a stick for operating high-tension disconnecting switches. It includes a hook 2 held in a rounded nose piece on the end of a handle 1. The tips of the hook are spaced at different distances from the center of the round nose piece. If the tool is used for cleaning deck gaps, the tips will extend to different depths in the gaps, where one tip may extend too deeply and get caught by the deck's underlying cross beams, and the other tip may not extend deeply enough to clean the entire depth of the gap. Although the nose piece on the Poole device can be modified according to the teaching of the U.K. patent, so as to provide a rounded nose piece, it will retain all its other disadvantages. Furthermore, no prior art hook device discloses that it can be used for cleaning deck gaps, or that their hooks should have particular dimensions. The hooks on the prior art devices are most likely too long or too short for cleaning deck gaps, so that they will either extend too far down and get caught or hindered by the cross beams, or they will not extend far down enough to properly clean the gaps.

OBJECTS AND ADVANTAGES

Accordingly, the numerous objects and advantages of my invention are as follows:

(a) to provide a tool which can remove the debris from the spaces or gaps between deck boards in an effective manner;

(b) to provide a tool which will work efficiently on both loose and lodged debris;

(c) to provide a tool which will pull lodged debris up and out of the gaps, not lodge it deeper;

(d) to provide a tool which will work efficiently on debris of all sizes;

(e) to provide a tool which reaches to sufficient depth to clean the whole of the space between adjacent deck boards;

(f) to provide a tool which can remove debris from a wide range of gap sizes;

(g) to provide a tool which will not catch on most cracks or checks that exist on the deck boards;

(h) to provide a tool which will not damage either the deck boards or any surface finish applied to them;

(i) to provide a tool which can be configured so that whatever the angle at which the handle is held relative to the deck surface, no interference with the deck support beams or joists is possible;

(j) to provide a tool which works with the operator applying either a pulling or pushing motion to the tool handle, thus providing economy of movement;

(k) to provide a tool which is comfortable to use for operators of different heights;

(l) to provide a tool which complies with modern standards of ergonomics; that is, no kneeling or bending is required to operate the tool;

(m) to provide a tool which is safe to use if used properly;

(n) to provide a tool which is long-wearing if used properly; and (o) to provide an effective tool which may be offered to the public at an affordable price.

Further objects and advantages of my invention will become apparent from a consideration of the drawings and ensuing description.

BRIEF DESCRIPTION OF THE DRAWING FIGURES

FIG. 4 shows a tool fitted with a tool head having two hook portions with a projecting rounded portion between.

Drawing Reference Numerals

10. Handle
12. Handle, Operator End
14. Handle End Cap
16. Handle, Working End
18. Nose Piece
20. Middle Elongated Portion Of Tool Head
24. Rivet
30. Tool Head
30A. Tool Head: Dual Thickness
30B. Tool Head: One Hook
30C. Tool Head: One Hook, One Small Blade
30D. Tool Head: One Hook, One Large Blade
30E. Tool Head: One Hook, One Forward-Projecting Hook
30F. Tool Head: Two Hook, Round Nose
30G. Tool Head: Rectangular, Perpendicular
30H. Tool Head: Rectangular, Forward-Projecting
30I. Tool Head: Rectangular, Rearward-Projecting
40. Operator
42. Deck Boards
44. Intermediate Gaps Between Boards
46. Cross Beam
R1. Radius Of Nose Piece
R2. Radius Of Tool Head
T. Thickness Of Deck Board

DESCRIPTION—FIGS. 1 to 6

Figure 1A:
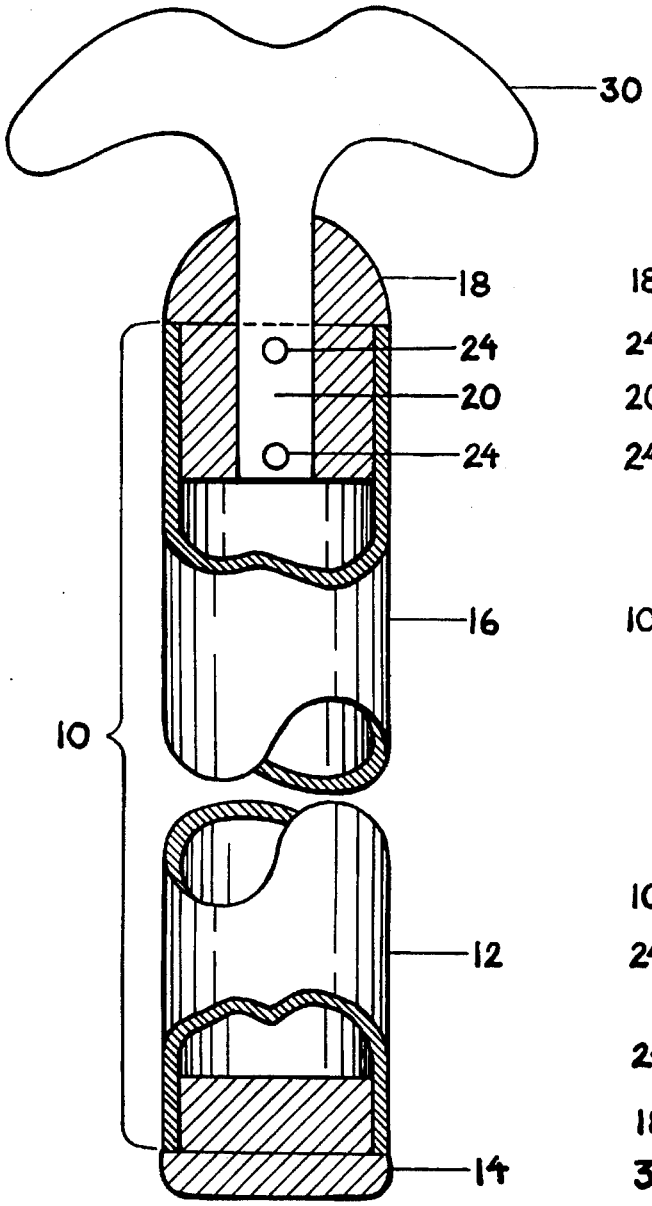
FIGS. 1A to 1D show various aspects of the tool fitted with a standard two-sided tool head.
Figure 1B:
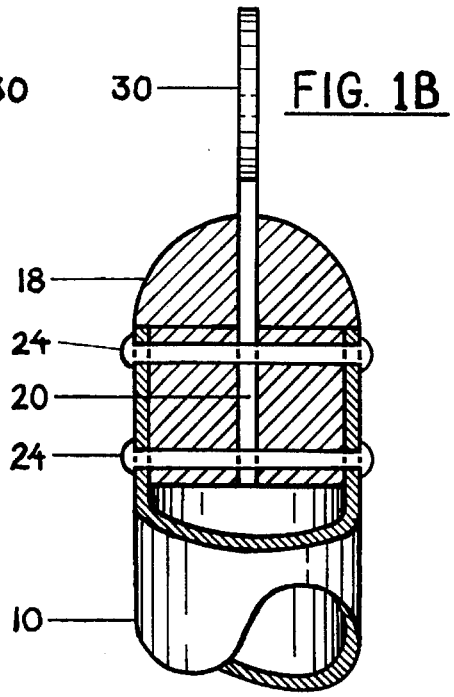
Figure 1C:
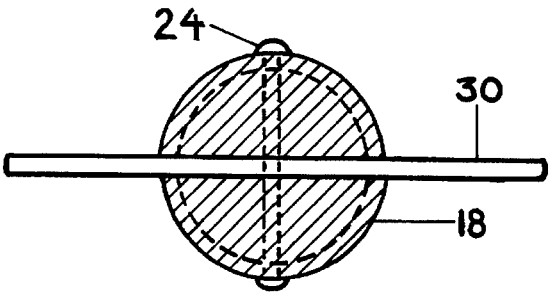
Figure 2B:
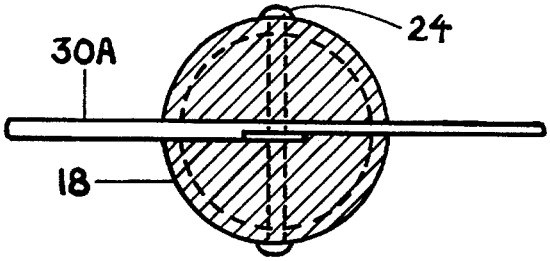
Figure 1D:
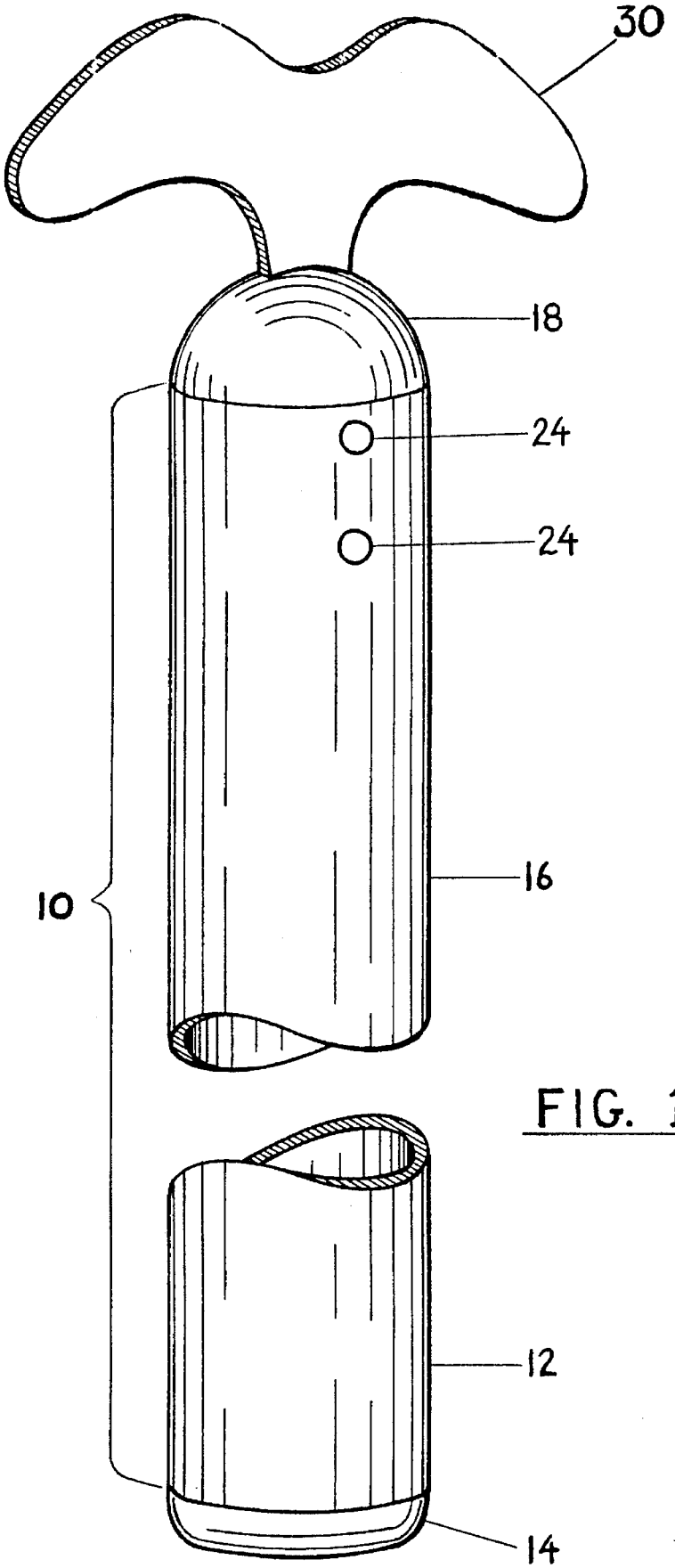

A typical embodiment of the hooked deck cleaning tool of the present invention is illustrated in FIG. 1A (side view, section through plane of tool head), FIG. 1B (side view, section perpendicular to plane of tool head), FIG. 1C (end view), and FIG. 1D (perspective view). The tool has a handle 10. In the preferred embodiment, handle 10 is an aluminum tube of approximately 1.5" (38 mm) in outside diameter and 71" (180 mm) in length. However, handle 10 can consist of any other suitable material or configuration; such as textured, knurled, polygonal, or grooved aluminum, hardwood, or reinforced fiberglass.

In the proximal end 12 of handle 10 is fitted a plastic end cap 14, which is rounded to avoid personal injury to the operator, or snagging of the operator's apparel.

In the forward end 16 of handle 10 is fitted a nose piece 18. Nose piece 18 consists of a cylindrical portion which is sized to fit tightly into handle 10, and a hemispherical portion having a slightly greater diameter than the outside diameter of handle 10. A hole of rectangular (or oval) cross-section is centered along the longitudinal axis of nose piece 18 to hold a middle elongated portion 20 of a generally T-shaped tool head 30, which is flat and symmetrical about middle portion 20. In the preferred embodiment, nose piece 18 is made of a high-density plastic to provide a low friction, non-marring sliding surface.

T-shaped tool head 30 consists of middle portion 20 and two adjoined opposite hooks or side portions which first extend upwardly and then curve downwardly through at least 90 degrees of arc to end in a downwardly extending terminal portion. In the preferred embodiment, tool head 30 is made from a single flat piece of austenitic stainless steel sheet approximately ⅛" (3 mm) thick. Tool head 30 may also be formed of other suitable materials, such as mild or hardened steel, aluminum, brass, titanium, hard plastic, etc.

Figure 2A:
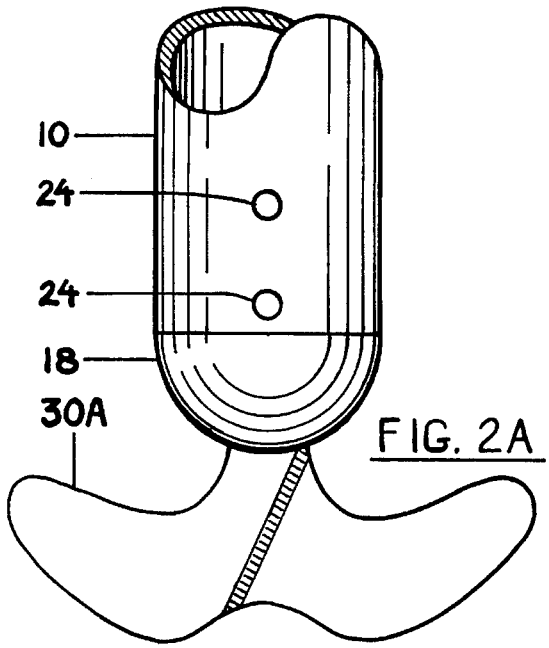
FIGS. 2A and 2B show a tool fitted with a two-sided tool head with each hooked portion being a different thickness.
Figure 3A:
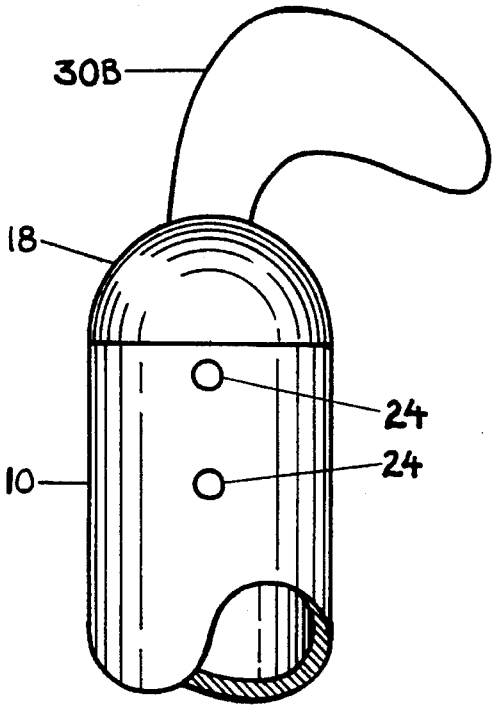
FIGS. 3A to 3D show various configurations of the tool fitted with a tool head having only one hooked portion.
Figure 3B:
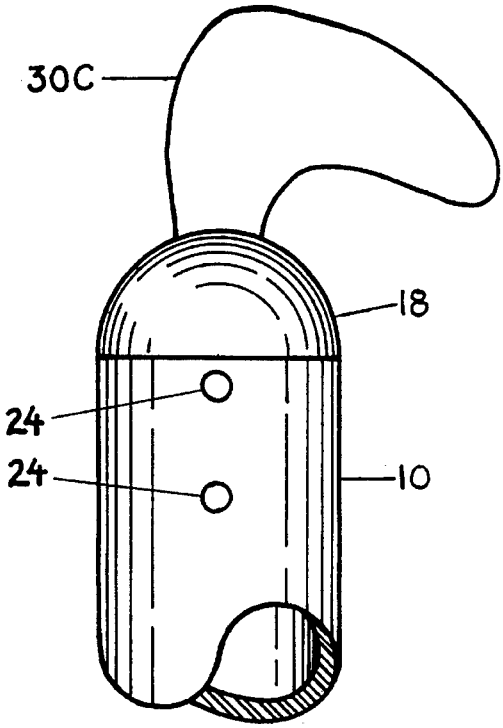
Figure 3C:
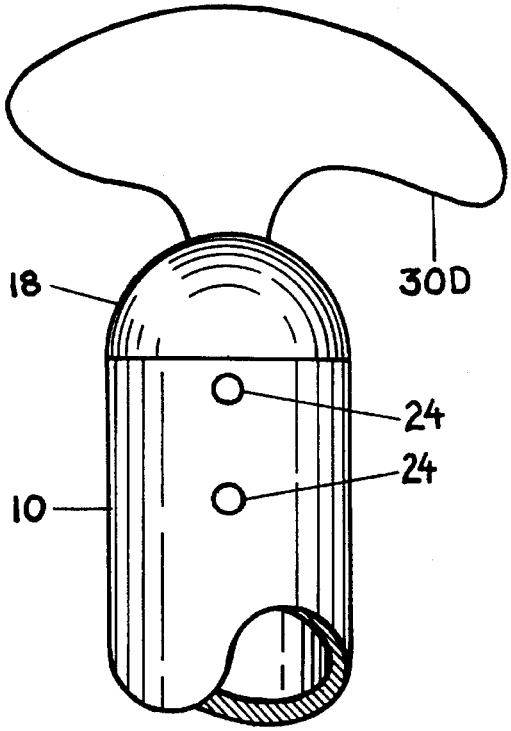
Figure 3D:
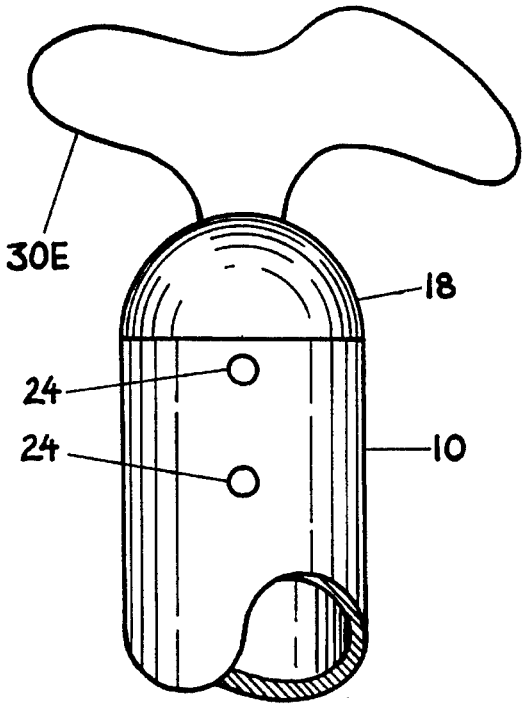
Figure 4:
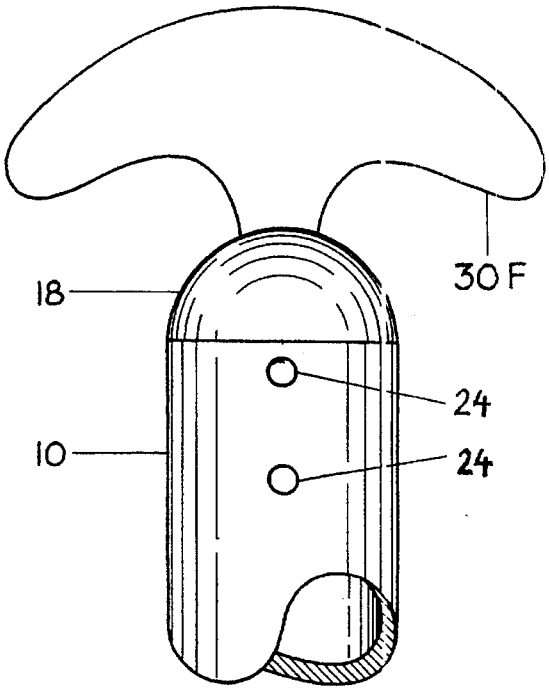
Figure 5A:
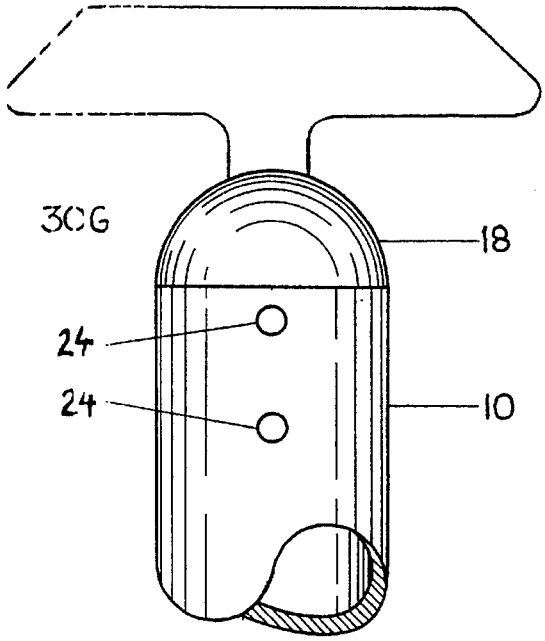
FIG. 5A to 5C show the tool fitted with two rectangular projecting portions instead of curved hook portions.
Figure 5B:
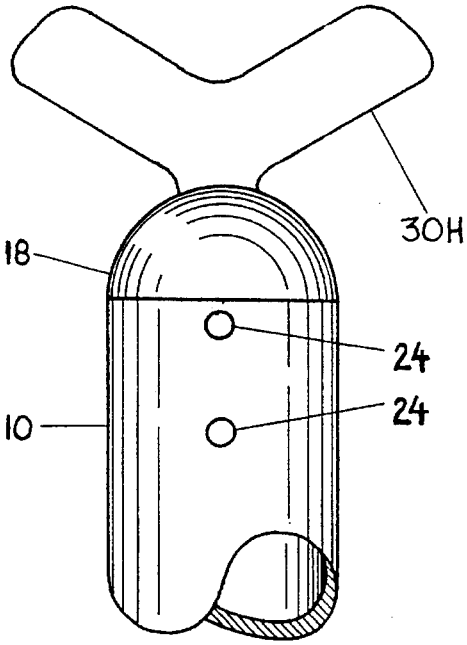
Figure 5C:
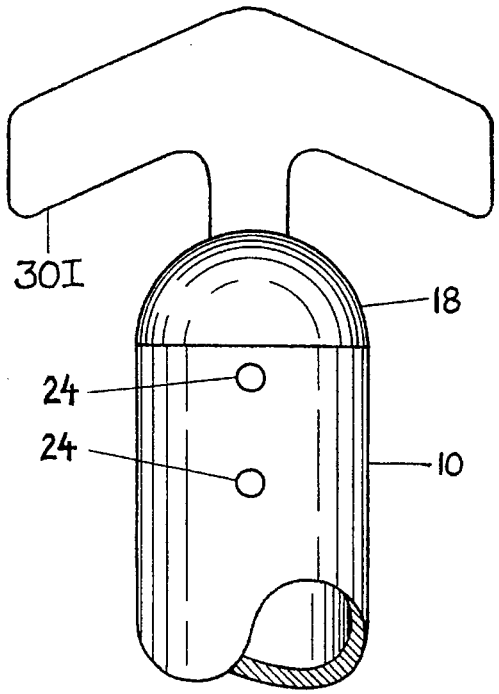

Additional embodiments of tool head 30 are shown in FIGS. 2A, 2B, 3A, 3B, 3C, 3D, 4, 5A, 5B, and 5C; in each case handle 10, cap 14 (FIG. 1 ), and nose piece 18 are the same as in the preferred embodiment (FIGS. 1A, 1B, 1C, and 1D). In FIG. 2A (side view) and FIG. 2B (end view) tool head 30A has two hook portions, with each hook portion being of a different thickness. In FIGS. 3A, 3B, 3C, and 3D tool heads 30B, 30C, 30D, and 30E have only one hook portion. FIG. 3A shows tool head 30B with a single rounded hook; FIG. 3B shows tool head 30C with a single hook and a small projection opposite the end of the hook; FIG. 3C shows tool head 30D with a single hook and having a large rounded blade portion opposite the hook; and FIG. 3D shows tool head 30E with a forward projecting hooked portion opposite the hook. In FIG. 4, tool head 30F has two hook portions with a projected rounded portion therebetween. In FIGS. 5A, 5B, and 5C tool heads 30G, 30H, and 30I have two opposite rectangular portions. FIG. 5A shows a tool with the rectangular portions perpendicular; FIG. 5B shows a tool with the rectangular portions projecting forward and away from handle 10; and FIG. 5C shows a tool with the rectangular portions projecting rearward and toward handle 10.

There are various possibilities with regard to the rigid attachment of tool head 30 to nose piece 18, and nose piece 18 to handle 10. In the preferred embodiment, as illustrated in FIGS. 1A and 1B, two to four rivets 24 (two are shown) are fitted into holes drilled perpendicularly to the plane of tool head 30 and through the longitudinal axes of handle 10, nose piece 18, and middle portion 20 of tool head 30. Combined with slight interference fits between middle portion 20 and nose piece 18, and nose piece 18 and handle 10, rivets 24 would provide for a strong and durable attachment. Other possible methods of attachment include, but are not limited to, bolts and nuts, screws, welding or soldering, pins or roll pins, crimping, and various forms of press or interference fit.

OPERATION—FIGS. 6 AND 7

Figure 6:
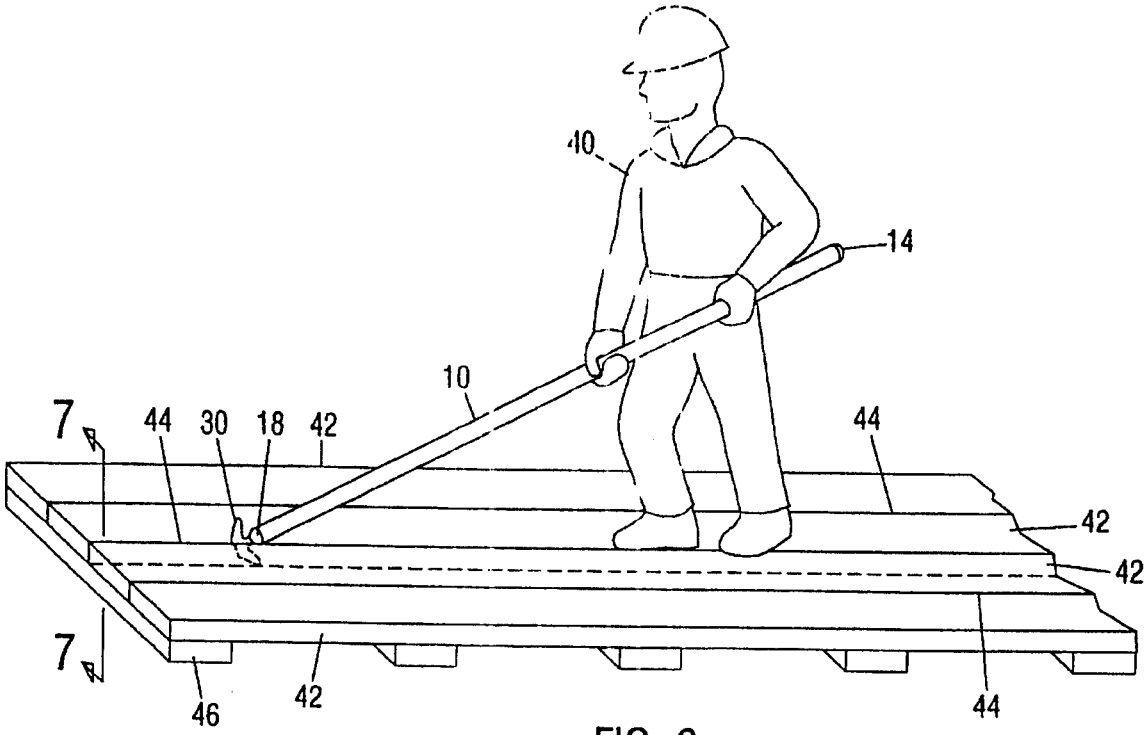
FIG. 6 shows the method of operation of the tool.

The method for using the hooked deck cleaning tool somewhat resembles that of using a push broom. As shown in FIG. 6, tool handle 10 is held in one or both hands of an operator 40, with tool head 30 forward of operator 40. One of the hooked portions of T-shaped tool head 30 is positioned in a gap 44 between two adjacent deck boards 42. A typical deck usually includes a series of supporting cross beams 46 attached under deck boards 42. Tool head 30 is dropped into gap 44 so that nose piece 18 is resting on the adjacent edges of boards 42. Handle 10 is positioned along the plane of the gap 44 which is being cleaned. Pushing the tool forward will result in debris (not shown) caught between boards 42 being moved upward and out of gap 44, or downward and out of gap 44, by the shape of tool head 30. Pulling the tool toward operator 40 will lift debris from the gap by the shape of the hooked portion(s) of tool head 30. The pulling action will quickly remove stubborn debris lodged below the deck surface. The combination of pushing and pulling the tool through each gap 44 results in the efficient and complete removal of all debris from the gaps between the boards of a wooden deck.

Figure 7:
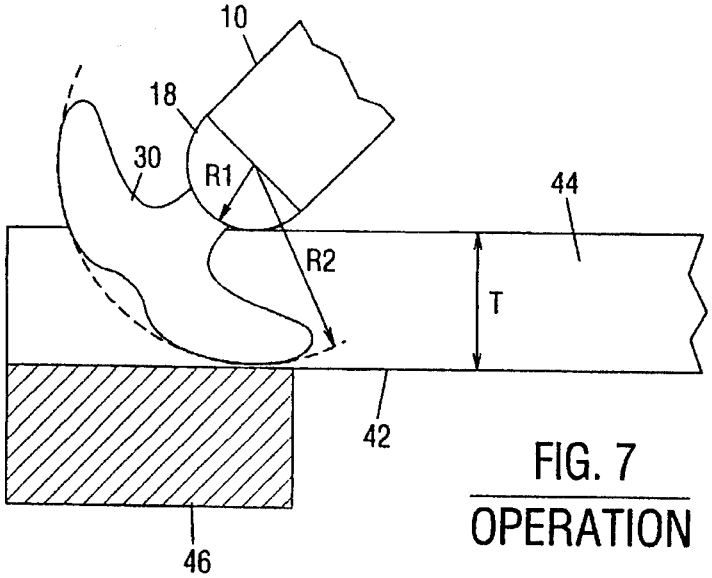
FIG. 7 shows the tool in use in an enlarged sectional view taken along line 7—7 in FIG. 6.

Conventional deck boards 42 and cross beams 46 are made from elongated pieces of lumber. Typically, two sizes of such lumber are used: "2×4" or "2×6." The so-called "2×4" has actual cross-sectional dimensions of about 1.40"×3.5" (3.6 cm×8.9 cm), and the so-called "2×6" has actual cross-sectional dimensions of about 1.40"×5.5" (3.6 cm×14 cm). Deck boards 42 are laid flat, so that they each have a height or thickness of 1.40" (3.6 cm), and a width of 3.5"(8.9 cm) or 5.5" (14 cm), depending on whether they are made from "2×4s" or "2×6s", respectively. As shown in FIG. 7, a typical deck board 42 made of either a "2×4" or a "2×6" piece of lumber has a thickness T of about 1.40" (3.6 cm). The actual thickness can vary between about 1.40" (3.6 cm) to about 1.46" (3.7 cm), depending on how accurately it was cut, and how wet or dry it is. The hemispherical portion of nose piece 18 has a center and a radius of R1, which in this example is about 0.75" (1.9 cm). The external portion of tool head 30 is sized so that its forward edge generally fits within a radius R2 from the center of nose piece 18. Radius R2 is selected so that the difference between R2 and R1 is equal to or slightly less than T. In this example, T is at least about 1.40" (3.6 cm), and R1 is about 0.75" (1.9 cm), therefore R2 should be about 2.15" (5.5 cm) or slightly less, so that tool head 30 extends substantially down the entire depth of gap 44, but not beyond. This allows tool head 30 to thoroughly clean out gap 44 from top to bottom, but without getting caught or being impeded by cross beams 46 as it is being moved linearly along gap 44. Although tool head 30 is flat enough to fit within the deck gap, it is also wide enough to provide enough strength to withstand the stress of normal use, so that it will not bend or break when handle 10 is moved out of the plane of gap 44.

SUMMARY, RAMIFICATIONS, AND SCOPE

Accordingly, the reader will see that I have provided a hooked tool for cleaning gaps between deck boards with the following advantages:

A. Both loose and lodged debris of all sizes will be removed from gaps between deck boards efficiently and effectively, as a result of the shape and the rigid nature of the tool head design.

B. The hooked tool head design will allow the operator to pull lodged debris up and out of the gaps between boards.

C. The shape and size of the tool head will allow the tool to reach to a sufficient depth to clean the whole of the space between adjacent deck boards without any interference with the deck support beams or joists.

D. It can clean gaps of different widths.

E. The design and materials of the nose piece and tool head prevent them from catching on most cracks and checks in the deck boards, or damaging either the deck boards or any surface finish applied to them.

F. At whatever angle the handle is held in relation to the deck surface while moving the tool linearly in the plane of the gap, will result in debris removal from the gap.

G. The ability of this tool design to work at all angles means it will be comfortable to use for operators of widely varying stature; it will also meet modern standards of ergonomics by allowing the operator to work standing, without any kneeling or bending.

H. It removes debris during both the push and the pull strokes to allow economy of movement.

I. It has no unsafe sharp edges or pointed parts to cause operator injury.

J. In the preferred embodiment, the materials used are durable and, if the tool is used properly, will provide for years of service.

Although the description above contains many specificities, these should not be construed as limiting the scope of the invention, but as merely providing illustrations of some of the presently preferred embodiments of this invention. For example, an extremely light-weight version could be fabricated from welded titanium parts. In order to provide a more distinctive, attractive appearance, the nose piece, handle, and end cap could be made one color, or a particular combinations of colors. Another effective variation would be to configure the nose piece to mount a wheel adjacent and parallel to both sides of the tool head; creating a rolling contact nose piece to further reduce friction. Unlimited variations and combinations of the tool head configurations shown in the drawings are also possible. The difference in radii between the hemispherical nose piece and the forward edge of the tool head can be changed to a suitable dimension for cleaning decks having gaps of other depths. The deck cleaning tool can also include a brush attached to either end of the handle to serve as broom, or the tool head and the brush can be made interchangeable on the same end of the handle. Therefore, the scope of the invention should be determined by the appended claims and their legal equivalents, rather than by the examples given.

I claim:

1. A tool for cleaning a gap between a pair of spaced apart boards of an architectural deck, said gap having a predetermined width, and a depth equal to a predetermined vertical thickness of said boards, said deck including a plurality of connecting cross beams attached under said boards, comprising:

a cylindrical elongated handle having a proximal end and a forward end, said handle having an axis and a predetermined diameter substantially greater than said width of said gap, a hemispherical nose piece attached to said forward end of said handle, said hemispherical nose piece having a center and a predetermined radius, and a flat and generally T-shaped tool head having a middle elongated portion attached to said nose piece and aligned with said axis of said handle, said T-shaped tool head being substantially symmetrical about said middle elongated portion, said T-shaped tool head having a curved forward edge positioned generally along an arc having a predetermined radius from said center of said nose piece, the difference between said radius of said arc and said radius of said nose piece being generally equal to said depth of said gap, whereby said tool head is positionable within said gap so that said nose piece is supported on top of said boards, and said tool head is extended down the entire depth of said gap, so that said tool head is movable linearly along said gap to clean the entire depth thereof without engaging and being impeded by said cross beams.

2. The tool of claim 1 wherein said handle is hollow, and said hemispherical nose piece includes a cylindrical portion extending into said handle.

3. The tool of claim 1 wherein said handle comprises an aluminum tube.

4. The tool of claim 1 wherein said nose piece is made of plastic.

5. The tool of claim 1 wherein said tool head is made of stainless steel.

6. The tool of claim 1 wherein said tool head is about 3 mm thick.

7. The tool of claim 1 wherein said T-shaped tool head includes two side portions which are angled backwardly more than 90 degrees.

8. A tool for cleaning a gap between a pair of spaced apart boards of an architectural deck, said gap having a predetermined width, and a depth of about 3.6 cm, said deck including a plurality of connecting cross beams attached under said boards, comprising:

a cylindrical elongated handle having a proximal end and a forward end, said handle having an axis and a predetermined diameter substantially greater than said gap, a hemispherical nose piece attached to said forward end of said handle, said hemispherical nose piece having a center and a predetermined radius, and a flat and generally T-shaped tool head having a middle elongated portion attached to said nose piece and aligned with said axis of said handle, said T-shaped tool head being substantially symmetrical about said middle elongated portion, said T-shaped tool head having a curved forward edge positioned generally along an arc having a predetermined radius from said center of said nose piece, the difference between said radius of said arc and said radius of said nose piece being about 3.6 cm, whereby said tool head is positionable within said gap so that said nose piece is supported on top of said boards, and said tool head is extended down the entire depth of said gap, so that said tool head is movable linearly along said gap to clean the entire depth thereof without engaging and being impeded by said cross beams.

9. The tool of claim 8 wherein said handle is hollow, and said hemispherical nose piece includes a cylindrical portion extending into said handle.

10. The tool of claim 8 wherein said handle comprises an aluminum tube.

11. The tool of claim 8 wherein said nose piece is made of plastic.

12. The tool of claim 8 wherein said tool head is made of stainless steel.

13. The tool of claim 8 wherein said tool head is about 3 mm thick.

14. The tool of claim 8 wherein said T-shaped tool head includes two side portions which are angled backwardly more than 90 degrees.

15. A tool for cleaning a gap between a pair of spaced apart boards of an architectural deck, said gap having a predetermined width, and a depth of about 3.6 cm, said deck including a plurality of connecting cross beams attached under said boards, comprising:

a tubular elongated handle having a proximal end and a forward end, said handle having an axis and a predetermined diameter substantially greater than said gap, a nose piece having a cylindrical portion positioned in said forward end of said handle, and a hemispherical portion extending therefrom, said hemispherical portion having a center and a predetermined radius, and a flat and generally T-shaped tool head having a middle elongated portion extending into said nose piece and aligned with said axis of said handle, said T-shaped tool head being substantially symmetrical about said middle elongated portion, said T-shaped tool head having a curved forward edge positioned generally along an arc having a predetermined radius from said center of said hemispherical portion, the difference between said radius of said arc and said radius of said hemispherical portion being about 3.6 cm, whereby said tool head is positionable within said gap so that said hemispherical portion is supported on top of said boards, and said tool head is extended down the entire depth of said gap, so that said tool head is movable linearly along said gap to clean the entire depth thereof without engaging and being impeded by said cross beams.

16. The tool of claim 15 wherein said handle comprises an aluminum tube.

17. The tool of claim 15 wherein said nose piece is made of plastic.

18. The tool of claim 15 wherein said tool head is made of stainless steel.

19. The tool of claim 15 wherein said tool head is about 3 mm thick.

20. The tool of claim 15 wherein said T-shaped tool head includes two side portions which are angled backwardly more than 90 degrees.

* * * * *